United States Patent [19]

Bodendorf et al.

[11] 4,337,117

[45] Jun. 29, 1982

[54] DECAY RESISTANT MATERIAL

[75] Inventors: Warren J. Bodendorf, Montgomery; Alphonse R. Presto, Holyoke, both of Mass.

[73] Assignee: Texon Inc., South Hadley, Mass.

[21] Appl. No.: 177,779

[22] Filed: Aug. 13, 1980

[51] Int. Cl.[3] ..... D21H 5/22

[52] U.S. Cl. ..... 162/161; 162/168.1; 162/168.2; 162/168.3; 162/168.5; 162/168.7; 162/169

[58] Field of Search ..... 162/161, 146, 168 NA, 162/168 R, 169

[56] References Cited

U.S. PATENT DOCUMENTS

| | | | |
|---|---|---|---|
| 3,493,464 | 2/1970 | Bowers et al. | 162/161 |
| 3,790,529 | 2/1974 | Fujimura et al. | 162/168 NA |
| 3,918,981 | 11/1975 | Long | 162/161 |
| 4,018,647 | 4/1977 | Wietsma | 162/169 |

FOREIGN PATENT DOCUMENTS 50-13610 2/1975 Japan .

OTHER PUBLICATIONS

"Lufax 295 For High Efficiency Wet-End Performance in Papermaking", Rohm & Haas Brochure.

*Primary Examiner*—William F. Smith

*Attorney, Agent, or Firm*—Webb, Burden, Robinson & Webb

[57] ABSTRACT

Synthetic sheet material is resistant to decay by fungus and other microbial organisms and particularly useful in shoe construction, mulch papers and the like. The material comprises a uniform distribution of cellulose and optionally synthetic fiber within a matrix or binder and is formed from a furnish of the fibers; a metallic quinolinolate which lends the material decay resistant; a polymer colloid such as an acrylic latex which prevents the coagulation of the subsequently added elastomeric binder by the metallic quinolinolate; and a cationic polymer which acts as a retaining agent for the metallic quinolinolate in the synthetic sheet material.

5 Claims, No Drawings

DECAY RESISTANT MATERIAL

BACKGROUND OF THE INVENTION

1. Field of the Invention

This invention relates to decay resistant sheet material and more particularly to such materials adapted for use in shoe construction.

2. Description of the Prior Art

For purposes of economy it has been the practice to employ synthetic sheet material in the manufacture of shoes, Such "shoeboard" as it has come to be known comprises a disposition of an elastomeric binder in a fibrous matrix and is currently in fairly extensive use in counters and shoe insoles. For durability, especially where the shoeboard is employed in tropical climates, the board must be treated with a substance which provides the board with resistance to decay by fungus and other microbial organisms, a property not naturally possessed by leather and other shoe construction constituents unless treated chemically.

Metallic quinolinolates, particularly copper-quinolinolate, effectively render some cellulosic materials resistant to fungus and bacteria. However, due to environmental and economic considerations they have not been successfully employed as a preservative or fungicide in shoeboard due to difficulty in processing and retention within the shoe materials over an extended period of time.

Prior art attempts to incorporate the metallic quinolinolates in a cellulosic sheet have proved less than satisfactory. For example, incorporation of the powdered form of the metallic quinolinolate by adding it to the paper slurry before deposition on the wire has proved ineffective due to low retention causing an effluent from the papermaking process which contains unacceptably high levels of metallic quinolinolates. Further, it is unacceptable to lose these amounts of metallic quinolinolates since they are expensive and it is desirable to have effective utilization of the quinolinolate. Further, size press application of a solubilized form of the copper-quinolinolate is also ineffective due to the leachability of the same by water.

Methods such as those disclosed in U.S. Pat. No. 3,493,464 to Bowers et al. and U.S. Pat. No. 3,713,963 to Hager demonstrate retention rates of approximately 70% of the theoretical by formation of the metallic quinolinolate in the pulper by the proper addition of the required compounds and precipitation thereof, in situ, of the insoluble salt. However, methods are also suggested to treat the paper machine effluent in order to remove the remaining quinolinolate therefrom.

Furthermore, it has been observed that the copper-quinolinolate being incompatible with the other popular insole binders namely, neoprene and styrene-butadiene rubber causes the coagulation of such binders, thereby severely adversely affecting the uniform saturation of the web with the binder along with the strength and resilience thereof.

Accordingly, it is an object of the present invention to provide a fungus and mold resistant synthetic sheet material which overcomes the deficiencies associated with the prior art.

It is another object of the present invention to provide a fungus and mold resistant sheet material employing a metallic quinolinolate as a fungicide.

It is another object of the present invention to provide a fungus and mold resistant sheet material of optimal strength and resilience.

It is another object of the present invention to provide a method of economically making a fungus and mold resistant sheet material with a fungicide which is retained by the sheet material at substantially maximum rates during the fabrication process. It is another object of the present invention to provide a fungus and mold resistant material which retains the fungicide therein over long periods of time.

It is another object of the present invention to provide a method of making fungus and mold resistant material wherein substantially none of metallic ions from a fungicide in the material are lost in the effluent or waste water.

These and other objects will become more readily apparent from the following summary of the invention and detailed description thereof.

SUMMARY OF THE INVENTION

A fungus and mold resistant sheet material is manufactured from a furnish containing a fibrous pulp, an ionic emulsion of a metallic quinolinolate as a fungicide and a cationic polymer for optimization of the retention of the metallic quinolinolate. The furnish further includes a polymer colloid compatible with both the metallic quinolinolate and a binder added in a subsequent step; the polymer colloid serves to prevent the metallic quinolinolate from causing the coagulation of the binder. The furnish is then formed into a web which is saturated with the binder, dried and calendered.

DETAILED DESCRIPTION OF THE INVENTION

In accordance with the present invention the decay resistant sheet material is formed generally by a papermaking process and the resulting sheet may be subsequently laminated to similar sheets to achieve any desired thickness, strength and stiffness.

In the manufacture of the sheet material, a furnish is first formed comprising a fibrous pulp and a cationic polymer. The fibers employed are primarily cellulosic fibers such as ordinary draft cook fibers or the more highly cooked wood cellulose such as the high alpha, sulfite types used as nitration grade, as well as jute, hemp, mercerized kraft and the like. A minor amount of the fibers may be synthetic such as acrylic, polyester, polyamide and the like, although such synthetic fibers are not strictly necessary. Preferably, the synthetic fibers may be used at a level of up to about 5% by weight based on the total weight of the fibrous constituents.

The cationic polymer is added to the pulp at a concentration of 0.4 to 2.0, and preferably 0.7 to 0.9 parts by weight based upon 100 parts by weight of the pulp, depositing on the surfaces of the fibers and providing association sites for the subsequently added metallic quinolinolate. In the preferred embodiment the cationic polymer is a polyelectrolyte sold under the tradename LUFAX 295 by Rohm & Haas Company and is added to the pulp as a 1.0 to 6.0 percent by weight aqueous solution. In addition to the cationic polyelectrolyte hereinbefore specified, cationic polyacrylamide polymers are also useful as the cationic polymer. The cationic polymer is provided in order to retain the metallic quinolinolate within the web during processing and additionally to retain the metallic quinolinolate within the sheet material during its use as shoeboard and the like.

The metallic quinolinolate emulsion, preferably a copper-8-quinolinolate is then added in the form of an emulsion to the pulp solution at a concentration of 5 to 12 parts by weight to 100 parts by weight of pulp.

The copper-8-quinolinolate is provided in the form of an anionic emulsion, and is readily bonded to the cationic polymer at the fiber surfaces. Such an emulsion is available from Ventrol Corporation under the name CUNNILATE 2419-75 containing 37.5% weight solids, 7.5% of which comprises copper-8-quinolinolate After the addition of the metallic quinolinolate, the pH of the mixture is raised approximately to between 8 to 11 and preferably about 8.5 by the addition of a suitable alkali salt such as sodium aluminate or the like. A polymer colloid is also added to prevent coagulation of the subsequently added saturant binder. The polymer colloid may be any latex which is compatible with the quinolinolate and the saturant binder. Preferably, the concentration of the polymer colloid is 5 to 12 parts by weight per 100 parts fiber.

In a preferred embodiment, the polymer colloid may comprise either an acrylic latex such as a heat reactive polyacrylate sold by B. F. Goodrich Co. under the tradename HYCAR 2600X112 or a styrene butadiene polymer. A dye may be added with the polymer to achieve any desired color of the sheet material.

The furnish is then formed into a web by any suitable apparatus such as, for example, a Fourdrinier machine, and the web is then wet-web saturated with a suitable binder and preferably an elastomeric binder in order to maintain the integrity of the sheet while enhancing the strength and resiliency thereof.

The binders useful in the practice of the invention are those which maintain the integrity of the sheet. When the sheet material is required to have flexible properties, it is preferable to use an elastomeric material as a binder. The term "elastomer" as used herein, is intended to mean both synthetic and natural rubber along with acrylic elastomeric resins and other synthetic elastomeric materials. "Natural rubber," as used herein, is the elastic solid obtained from the sap or latex of the Hevea tree, the major constituent being the homopolymer of 2-methyl 1-3 butadiene (isoprene). "Synthetic rubber" as used herein, is meant to encompass polymers based upon at least 2% of a conjugated unsaturated monomer, the conjugation being in the 1 to 3 position in the monomer chain. The acrylic elastomer useful in the practice of the invention may be included with the general scope of synthetic rubber, but necessarily included monoethylenically unsaturated monomers. The monoethylenically unsaturated monomers are, but not limited to, the acrylic monomers such as methacrylic acid, acrylic acid, acrylonitrile, methacrylonitrile, methylacrylate, methylmethacrylate, ethylmethacrylate, and the like; monoethylenically unsaturated hydrocarbons such as ethylene, butadiene, propylene, styrene, alpha-methylstyrene and the like; and other functional unsaturated monomers such as vinylpyridine, vinylpyrrolidone and the like functional vinylic monomers.

When the sheet material is to be used in the construction of shoes and must exhibit flexibility over its life time, it is preferred to use the acrylic elastomers because the flexibility properties of the sheet material fabricated with the acrylic elastomers do not substantially degrade over time. The use of acrylic elastomers in combination with metallic quinolinolates is more fully disclosed in U.S. application Ser. No. 177,778 entitled "Decay Resistant Material with Retained Flexibility" of Warren J. Bodendorf incorporated herein by reference and filed the same date as this application.

After wet-web saturation, the web is calendered to a suitable gauge and dried. The resulting sheet exhibits a substantially complete retention of the metallic quinolinolate and therefore, exhibits an effective long term resistance to fungus, mold and other microbial organisms. Moreover, the substantially complete retention of all the metallic quinolinolate in the web during processing causes the effluent or process waste water to be substantially free of metallic ions. Preferably, the metal content due to the quinolinolate of the total process effluent is below 5 ppm and more preferably below 2 ppm. Thus specialized pollution abatement equipment required in prior art processes to remove such metals from the process effluent are not required. The prevention of binder coagulation renders the sheet material strong and durable and of uniform consistency.

The following Examples illustrate the typical preparation of the sheet material of the present invention and the physical properties associated therewith.

EXAMPLE I

A pulper was furnished with 2000 lbs. of sulfite pulp and 100 lbs. of ½ inch 2.2 denier nylon fiber to which 45 gallons of a 4.7% solution of a cationic polymer such as the hereinbefore described LUFAX 295 were added. 22.5 gallons (193 lbs.) of the CUNNILATE 2419-75 were added with sufficient sodium aluminate to raise the pH of the admixture to 8.5. The furnish was completed by the addition of 45.5 gallons of the HYCAR 2600X112 and 1 lb. 5 oz. of a dye to rid the furnish of the green tint caused by the copper-8-quinolinolate.

The resulting furnish was then fed to a Fourdrinier machine forming the furnish into a 48.5 inch wide web of 0.109 inch thickness at a speed of 5.2 yards/minute.

Following formation, the web was then saturated with a neoprene latex binder, calendered to 0.091 inch and dried.

Samples of effluent water tested during the above process showed the copper content of such effluent to be approximately 1.27 ppm with a combined total process effluent copper concentration of approximately 0.625 ppm well within acceptable limits and corresponding to a copper-quinolinolate retention of over 99%. Thus no specialized pollution abatement equipment was required to remove copper from any waste water.

EXAMPLE II

Example I was repeated except that the neoprene latex binder was replaced with an acrylic elastomeric binder sold under the tradename NACRYLIC 25-4280 by National Starch & Chemical Corporation. The NACRYLIC 25-4280 latex is a self-reactive acrylic latex having a solids of 51% by weight, a pH of 2.9, a viscosity of 100 centipoise, and is anionic. Typical film properties of the latex are such that the film exhibits 600% elongation, a tensile strength of 350 psi, a second order glass transition temperature of 4° C. and a Sward Rocker Hardness of 0. The HYCAR 2600X112 was replaced with Polymerics 410 acrylic resin emulsion. The copper concentration of the total process affluent was less than 0.50 ppm representing substantially complete retention of the copper-quinolinolate.

EXAMPLE III

A fungus and mold resistant sheet 0.129 inch thick was manufactured in accordance with the process set forth in Example I with the exception that a styrene-butadiene polymer latex was substituted for the HYCAR for prevention of binder coagulation and Nitration Q fibers produced by ITT-Rayonier, Inc. were substituted for the sulfite pulp and nylon. The copper concentration of the total process effluent was 0.40 ppm representing substantially complete retention of copper-quinolinolate.

Sheet materials were prepared in accordance with Examples I through III of sufficient gauge to be used as insoles for shoes. Physical properties of the Examples fabricated into sheet material are shown in Table I as are the same properties for neoprene impregnated shoeboard of comparable thickness, commonly known as Qualiflex T-499, produced by Texon Inc.

It will be noted that the sheet material of the present invention exhibits properties such as tear strength and flexibility which render it ideally suited for use as shoeboard. The results of physical testing of the examples along with the Qualiflex T-499 are shown below in Table I.

TABLE I

| Property | | EXAMPLE I | EXAMPLE II | EXAMPLE III | T-499 | T-499 |
|---|---|---|---|---|---|---|
| Gauge (in) | | 0.091 | .117 | 0.129 | 0.090 | 0.129 |
| lbs/yd$^2$ | | 2.66 | 3.61 | 4.02 | 3.14 | 4.04 |
| pH | | 7.5 | 5.0 | | 8.8 | |
| Porosity sec/100 cm$^3$ air | | 8.2 | 15 | | 31 | |
| Tensile (lbs/in) | MD[1] | 191 | 292 | 308 | 262 | 322 |
| | CD[2] | 115 | 192 | 190 | 159 | 186 |
| Elongation % | MD[1] | 17 | 15 | 16.25 | 13 | 11.3 |
| | CD[2] | 32 | 24 | 26.0 | 25 | 24.7 |
| Edge Tear (lbs) | MD[1] | 199 | 108 | 268 | 85 | 133 |
| | CD[2] | 132 | 157 | 198 | 90 | 129 |
| Taber Stiffness | MD[1] | 1080 | 2700 | 3150 | 2560 | 3942 |
| | CD[2] | 520 | 1500 | 1300 | 1005 | 2050 |
| Elmendorf Tear (grams) | MD[1] | 2250 | 3700 | 4000 | 2500 | 3717 |
| | CD[2] | 3200 | 3800 | 5050 | 3200 | 4700 |
| Internal Bond (grams) | MD[1] | 3150 | 2425 | 3100 | 2450 | 3000 |
| | CD[2] | 2300 | 1850 | 2200 | 2100 | 2467 |
| Mullen (lbs) | | 450 | 580 | 670 | 460 | 620 |
| Wet Rub | | 60 × 57 | 1000 × 373 | 55 × 57 | 92 × 97 | 92 × 97 |
| Flex Endurance[3] | | 9944 × 3352 | 5364 × 4034 | 11,198 × 12,375 | 4480 × 3100 | 7146 × 4000 |
| Taped Mullen | | 310 | 180 | | 322 | |
| Absorption 24 hrs; % incorp. in weight | | 75.9 | | | 69 | |

[1]MD = Machine Direction
[2]CD = Cross Direction
[3]According to Satra physical test method STM. 129 M, 1966

With respect to decay resistance, the T-499 and the sheet material provided in accordance with Example I were submitted to a soil burial test in accordance with a common Federal Government mildew resistance test procedure. The soil comprised good top soil (low to moderate clay content) well rotted and shredded manure of leaf mold and coarse sand. The soil was rich in microbial life which decomposes cellulose. The tensile strength of samples both before and after burial are set forth in Table II.

TABLE II

| Property | | EXAMPLE I | T-499 |
|---|---|---|---|
| Original Tensile Strength lbs./in. | MD | 152 | 200 |
| | CD | 88 | 132 |

TABLE II-continued

| Property | | EXAMPLE I | T-499 |
|---|---|---|---|
| Tensile Strength after 14 days burial lbs./in. | MD | 156 | 92 |
| | CD | 96 | 70 |
| Tensile Strength after 56 days burial lbs./in. | MD | 156 | nil |
| | | 96 | nil |

An atomic absorption test on the material of Example I after 56 days burial showed the metallic copper percentage in the sheet to be 0.059% which is approximately equal to that added in the beater.

It will be observed that the copper-quinolinolate treated sheet material of the present invention is substantially totally resistant to decay from fungus, mildew and other microbial life while the T-499 material lost approximately one-half its tensile strength after 14 days and essentially all of it after 8 weeks due to decay.

As is shown by the Examples and the testing of the materials prepared in accordance with the invention, two distinct advantages are provided. The first advantage is greater than 99% retention of the metal-quinolinolate during processing, thus allevating environmental problems normally associated with the use of metal-quinolinolates. The second advantage is the retention of the metal-quinolinolate in the final product, again at levels greater than 99% to prevent the decay of the material.

Thus although the invention has been described by reference to specific ingredients and specific processes, the invention is only to be limited so far as is set forth in the accompanying claims.

We claim:

1. A process for manufacturing a wet laid synthetic fibrous sheet material which is resistant to decay by microbial organisms according to a papermaking technique including:

providing a furnish of a fibrous slurry 5 to 12 parts by weight to 100 parts by weight of fiber metal-quinolinolate emulsion, a cationic polymer, and a polymer colloid;

forming said furnish into a web;

saturating said web with a binder; and drying said web to form a fibrous sheet with fibers and metal-quinolinolate uniformly distributed throughout said binder, said cationic polymer being provided at a sufficient level to retain greater than 99% of said metal-quinolinolate in said sheet during formation.

2. The process of claim 1 wherein the metal content due to the metal-quinolinolate of the total process effluent is below 5 ppm.

3. The process of claim 2 wherein said metal content is below 2 ppm.

4. The process of claim 1 wherein said cationic polymer is present at a level of 0.4 to 2.0 parts by weight based on 100 parts by weight of fibers.

5. The process of claim 4 wherein said cationic polymer is present at a level of 0.7 to 0.9 parts by weight based upon 100 parts of said fiber.

* * * * *

REEXAMINATION CERTIFICATE (185th)

United States Patent [19]

Bodendorf et al.

[11] B1 4,337,117

[45] Certificate Issued Mar. 27, 1984

[54] DECAY RESISTANT MATERIAL

[75] Inventors: Warren J. Bodendorf, Montgomery; Alphonse R. Presto, Holyoke, both of Mass.

[73] Assignee: Texon Inc., South Hadley, Mass.

Reexamination Request:
No. 90/000,294, Nov. 22, 1982

Reexamination Certificate for:

| | |
|---|---|
| Patent No.: | **4,337,117** |
| Issued: | **Jun. 29, 1982** |
| Appl. No.: | **177,779** |
| Filed: | **Aug. 13, 1980** |

[51] Int. Cl.[3] ..... D21H 5/22

[52] U.S. Cl. ..... 162/161; 162/168.1; 162/168.2; 162/168.3; 162/168.5; 162/168.7; 162/169

[58] Field of Search ..... 162/161; 36/43, 44; 428/904

[56] References Cited

U.S. PATENT DOCUMENTS

| | | | |
|---|---|---|---|
| 1,756,035 | 4/1930 | Rose et al. . | |
| 2,125,947 | 8/1938 | Novak . | |
| 2,558,639 | 6/1951 | Uber . | |
| 2,563,897 | 8/1951 | Wilson et al. | 162/166 |
| 2,694,633 | 11/1954 | Pattiloch . | |
| 2,745,744 | 5/1956 | Weidner et al. . | |
| 2,926,154 | 2/1960 | Keim | 162/164.3 |
| 3,016,325 | 1/1962 | Pattiloch . | |
| 3,033,865 | 5/1962 | Fronmuller et al. | 260/270 |
| 3,240,761 | 3/1966 | Keim | 162/164.3 |
| 3,248,353 | 4/1966 | Coscia | 162/164.3 |
| 3,493,464 | 2/1970 | Bowers et al. | 162/161 |
| 3,713,943 | 1/1973 | Hager | 162/161 |
| 3,790,529 | 2/1974 | Fujimura et al. | 162/168.2 |
| 3,918,981 | 11/1975 | Long | 162/161 |
| 3,998,944 | 12/1976 | Long | 424/29 |
| 4,018,647 | 4/1977 | Wietsma | 162/169 |
| 4,176,108 | 11/1979 | Caimi et al. | 427/392 |

FOREIGN PATENT DOCUMENTS

| | | |
|---|---|---|
| 50-13610 | 2/1975 | Japan . |
| 1307988 | 2/1973 | United Kingdom . |
| 1364422 | 8/1974 | United Kingdom . |

OTHER PUBLICATIONS

Technical Report 70-62-PR: Biodegration of Shoeboard and Leatherboard Footwear.
Counter Materials: Marvin Greenberg et al: Apr. 1970 U.S. Army Natick Laboratories.
Military Specification MIL C 41814C Jun. 8, 1972.
Military Specification: MIL C 41814E Apr. 20, 1978.
Cunilate No. 2419-75: Ventron Corporation, Beverly, Ma. 01915.
Fungicides for Products of the Paper Industry, Tappi: Aug. 1956.
Copper-8-Quinolinolate (Solubilized) as a Wood Preservative: American Wood Preservative Association 1962.
The Effect of Fungitoxicants on the Physical Properties of Various Elastomers: Mitten et al., 1965.
Acrylic Resins: Horn: Reinbold Plastics 1962.
Rhoplex Acrylic Emulsion for Paper Saturation, Rohm and Haas Co. 1965.
Improving Paper with Hycar and Good-Rite Latexes: Goodrich Chem. Co.
Characteristic Properties of Acrylic Nonwoven Saturants, Bakule et al: Tappi: 1973.
Neoprene Latex: John C. Carl, Dupont 1962.
Neoprene Treated Paper: C. H. Gelbert: Dupont.
Effect of Fiber, Pulp, and Binder Variables on Characteristics of Wet-Laid Nonwovens: Gill: Tappi 1972.
Change in Pulp Surface Charge During Beater Deposition of Latex: Latimer; Tappi; 1973.
Lufax 295: Rohm and Haas.

*Primary Examiner*—William F. Smith

[57] ABSTRACT

Synthetic sheet material is resistant to decay by fungus and other microbial organisms and particularly useful in shoe construction, mulch papers and the like. The material comprises a uniform distribution of cellulose and optionally synthetic fiber within a matrix or binder and is formed from a furnish of the fibers; a metallic quinolinolate which lends the material decay resistant; a polymer colliod such as an acrylic latex which prevents the coagulation of the subsequently added elastomeric binder by the metallic quinolinolate; and a cationic polymer which acts as a retaining agent for the metallic quinolinolate in the synthetic sheet material.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 41–53:

In the manufacture of the sheet material, a furnish is first formed comprising a fibrous pulp and a cationic polymer. The fibers employed are primarily cellulosic fibers such as ordinary [draft] *kraft* cook fibers or the more highly cooked wood cellulose such as the high alpha, sulfite types used as nitration grade, as well as jute, hemp, mercerized kraft and the like. A minor amount of the fibers may be synthetic such as acrylic, polyester, polyamide and the like, although such synthetic fibers are not strictly necessary. Preferably, the synthetic fibers may be used at a level of up to about 5% by weight based on the total weight of the fibrous constitutent.

Column 3, lines 7–12:

The copper-8-quinolinolate is provided in the form of an anionic emulsion and is readily bonded to the cationic polymer at the fiber surfaces. Such an emulsion is available from [Ventrol] *Ventron* Corporation under the name CUNNILATE 2419-75 containing 37.5% weight solids, 7.5% of which comprises copper-8-quinolinolate. *Accordingly in the preferred practice of the invention, the 5 to 12 parts by weight of metal quinolinolate emulsion provides from 0.375 to 0.9 parts by weight metal quinolinolate based on 100 parts by weight fiber.*

Column 4, lines 54–68:

Example I was repeated except that the neoprene latex binder was replaced with an acrylic elastomeric binder sold under the tradename NACRYLIC 25-4280 by National Starch & Chemical Corporation. The NACRYLIC 25-4280 latex is a self-reactive acrylic latex having a solids of 51% by weight, a pH of 2.9, a viscosity of 100 centipoise, and is anionic. Typical film properties of the latex are such that the film exhibits 600% elongation, a tensile strength of 350 psi, a second order glass transition temperature of 4° C. and a Sward Rocker Hardness of 0. The HYCAR 2600X112 was replaced with Polymerics 410 acrylic resin emulsion. The copper concentration of the total process [affluent] *effluent* was less than 0.50 ppm representing substantially complete retention of the copper-quinolinolate.

Column 5 lines 64–68:

Column 6, lines 1–9:

TABLE II

| Property | | EXAMPLE I | T-499 |
|---|---|---|---|
| Original Tensile | | | |

TABLE II-continued

| Property | | EXAMPLE I | T-499 |
|---|---|---|---|
| Strength lbs./in. | MD | 152 | 200 |
| | CD | 88 | 132 |
| Tensile Strength after 14 days burial lbs./in. | MD | 156 | 92 |
| | CD | 96 | 70 |
| Tensile Strength after 56 days burial lbs./in. | MD | 156 | nil |
| | CD | 96 | nil |

AS A RESULT OF REEXAMINATION, IT HAS BEEN DETERMINED THAT:

Claims 1–3, having been finally determined to be unpatentable, are cancelled.

Claim 4 is determined to be patentable as amended:

Claim 5, dependent on an amended claim, is determined to be patentable.

New claims 6–17 are added and determined to be patentable.

4. The process of claim [1] *6* wherein said cationic polymer is present at a level of 0.4 to 2.0 parts by weight based on 100 parts by weight of fibers.

*6. A process for manufacturing a wet laid, synthetic fibrous sheet material resistant to decay by microbial organisms, according to papermaking techniques and comprising the steps of:*

*a. forming a furnish by the steps in the sequence listed and which consist essentially of:*

*1. providing a dispersion of fibers consisting essentially of cellulosic fibers,*

*2. adding a cationic polymer in an amount sufficient to retain greater than 99% of the amount of metal quinolinolate added in step 3. below in said sheet material during formation,*

*3. adding an anionic metal-quinolinolate emulsion providing from 0.375 to 0.9 parts by weight metal quinolinolate based on 100 parts by weight fiber, and*

*4. adding a polymer colloid in an amount sufficient to prevent coagulation of the binder added in step C by said metal quinolinolate,*

*b. forming the furnish into a web,*

*c. saturating the web with a binder, and*

*d. drying the web to form a fibrous sheet with fibers and quinolinolate uniformly distributed throughout the binder and where the amount of metal quinolinolate retained in the sheet material is greater than 99% of the amount of metal quinolinolate included in the furnish.*

*7. A process of claim 6 where said polymer colloid is a polyacrylate or a stryene-butadiene polymer.*

*8. A process of claim 6 where said metal quinolinolate emulsion is a copper-8-quinolinolate emulsion.*

*9. A process for manufacturing a wet laid, synthetic fibrous sheet material resistant to decay by microbial organisms, according to papermaking techniques and comprising the steps of:*

*a. forming a furnish by the steps in the sequence listed and which consist essentially of:*

*1. providing a dispersion of fibers consisting essentially of cellulosic fibers,*

2. adding a cationic polymer in an amount sufficient to retain greater than 99% of the amount of metal quinolinolate added in step 3. below in said sheet material during formation, 3. adding an anionic metal-quinolinolate emulsion providing from 0.375 to 0.9 parts by weight metal quinolinolate based on 100 parts by weight fiber, and 4. adding a polymer colloid in an amount between 5 to 12 parts by weight based on 100 parts by weight fiber, b. forming the furnish into a web, c. saturating the web with a binder, and d. drying the web to form a fibrous sheet with fibers and quinolinolate uniformly distributed throughout the binder and where the amount of metal quinolinolate retained in the sheet material is greater than 99% of the amount of metal quinolinolate included in the furnish.

10. A process of claim 9 where the metal quinolinolate emulsion is a copper-8-quinolinolate emulsion.

11. A process of claim 9 or claim 10 where the amount of cationic polymer is from 0.4 to 2.0 parts by weight based on 100 parts by weight fiber.

12. A process of claim 9 where the fibers include cellulosic fibers and from 0 to about 5 percent by weight synthetic fibers based on the total weight of fibers.

13. A process of claim 9 where the polymer colloid is a polyacrylate or styrene-butadiene polymer.

14. A process of claim 9 where the cationic polymer is a cationic polyelectrolyte.

15. A process for manufacturing a wet laid, synthetic fibrous sheet material resistant to decay by microbial organisms according to papermaking techniques and comprising the steps of:

a. forming furnish by the steps in the sequence listed and which consist essentially of:

1. providing a dispersion of fibers consisting essentially of cellulosic fibers, 2. adding a cationic polyelectrolyte polymer in an amount from 0.4 to 2.0 parts by weight based on 100 parts by weight fiber, the amount of cationic polyelectrolyte polymer being sufficient to retain greater than 99% of the amount of copper-8-quinolinolate in step 3. below in said sheet material during formation, 3. adding an anionic copper-8-quinolinolate emulsion providing from 0.375 to 0.9 parts by weight copper-8-quinolinolate based on 100 parts by weight fiber, 4. adding a polymer colloid in an amount from 5 to 12 parts by weight based on 100 parts by weight fiber, b. forming the furnish into a web, c. saturating the web with a binder, and d. drying the web to form a fibrous sheet with fibers and copper-8-quinolinolate uniformly distributed throughout the binder and where the amount of copper-8-quinolinolate retained in the sheet material is greater than 99% of the copper-8-quinolinolate included in the furnish.

16. A process of claim 15 where the fibers include cellulosic fibers and from 0 to about 5 percent by weight synthetic fibers based on the total weight of fibers.

17. A process of claim 15 where the polymer colloid is a polyacrylate or styrene-butadiene polymer.

* * * * *